United States Patent [19]

Weisbach

[11] 4,360,196

[45] Nov. 23, 1982

[54] SHEET-FEEDING ARRANGEMENT

[75] Inventor: Günter Weisbach, Radebeul, German Democratic Rep.

[73] Assignee: VEB Kombinat Polygraph "Werner Lamberz" Leipzig, Leipzig, German Democratic Rep.

[21] Appl. No.: 169,928

[22] Filed: Jul. 17, 1980

[30] Foreign Application Priority Data

Aug. 7, 1979 [DD] German Democratic Rep. ... 214721

[51] Int. Cl.[3] ..... B65H 9/00

[52] U.S. Cl. ..... 271/235; 271/237; 271/245

[58] Field of Search ..... 271/235, 237, 236, 239, 271/245

[56] References Cited

U.S. PATENT DOCUMENTS 2,011,745 8/1935 Wormser ..... 271/237 X 4,235,431 11/1980 Abrams .

*Primary Examiner*—Richard A. Schacher

*Attorney, Agent, or Firm*—Michael J. Striker

[57] ABSTRACT

A sheet-feeding arrangement for transferring sheets from supply stack to a printing machine includes a sheet-feeding table having a rear end and a front end. A pair of belt conveyors are provided in the arrangement for advancing a group of overlapped sheets from one end of the table to another. A first pair of stops for preliminary aligning of the sheets being advanced is arranged rearwardly from the front edge of the table and a second pair of stops are arranged at the front edge of the table for final aligning of the sheets being transferred. The first pair of stops are spaced from the second pair of stops in the direction of sheet advancement by a distance which is at least equal to the length of the individual sheet of the stream to prevent interference of the group of the following advancing sheets with the group of the preceding advancing sheets being moved from the preliminary steps towards the final stops.

7 Claims, 2 Drawing Figures

SHEET-FEEDING ARRANGEMENT

BACKGROUND OF THE INVENTION

The invention relates to systems for transferring sheets in sheet-processing machines and, more particularly, to sheet-feeding arrangements in printing machines.

In the known sheet-feeding arrangements for aligning and feeding sheets to printing machines, a number of individual sheets separated from the feeder stack is fed to aligning means mounted on a feeding table in the form of a stream of overlapped sheets. The known arrangement is described for example in Pat. No. 132,642 of the German Democratic Republic. This arrangement is provided with aligning means having front stops mounted at or before a feed table. These means can be pivoted out of the path of the sheets by an appropriate drive. The arrangement also includes another aligning means with stop means and a pulling device positioned between the first aligning means and the second aligning means, and a movable transporting suction head located before the second aligning means.

SUMMARY OF THE INVENTION

It is an object of the invention to provide an improved arrangement for transferring sheets in a printing machine.

Another object of the invention is to provide a sheet-feeding arrangement with aligning means which are advanced with a relatively high feeding velocity.

Still another object of the invention is to provide a sheet-feeding arrangement where the advancing sheets when moved between two aligning devices are positioned in overlapped relationship with respect to each other.

These and other objects of the invention are attained according to the present invention in a sheet-feeding arrangement comprising a sheet-feeding table having a rear end and a front end, means for advancing a stream of overlapped sheets from the rear end towards the front end of the table, preliminary sheet aligning means rearwardly spaced from the front end, and final sheet-aligning means at the front end of the table, the preliminary and final sheet-aligning means being spaced from one another in the direction of sheet advancement by a distance which is at least equal to the length of the individual sheets of the stream.

The advancing means may include a pair of belt conveyors each located before the corresponding aligning means in the direction of sheet advancement.

A transporting suction head may be arranged in the region of the preliminary aligning means.

The belt conveyors may have different velocities of movement of their corresponding belts.

The preliminary aligning means include laterally spaced stops arranged to pivot downwardly to allow the stream of overlapped sheets to be further advanced toward the final aligning means.

The final aligning means include a pair of stops laterally spaced from each other.

Pulling means may be provided in the arrangement for aligning the lateral edges of the sheets being advanced.

By positioning the preliminary sheet-aligning means apart from final sheet-aligning means by a distance of least equal to the length of one individual sheet unfavorable effects upon the sheets already abutting the final aligning means and movement of the preliminary aligning means in and out of the sheet path, are avoided and satisfactorily aligned advancing sheets may be obtained. These sheet overlap each other in their path between the preliminary sheet-aligning means and the final sheet-aligning means and form a group of overlapped sheets which is further moved under slippage toward the final aligning stops so that even the sheets which are displaced automatically in a reversed direction continue to move toward the final aligning means.

It has been proved advantageous that after aligning the sheets in the preliminary aligning means, a restored group of overlapped sheets may be formed which is further advanced towards the final aligning stops. Thus a group of overlapped sheets formed before engaging the preliminary sheet-aligning means and the group of sheets formed after releasing therefrom have a different extent of overlapping. A larger extent of overlapping in a group of sheets before engaging with the preliminary sheet-aligning means was found favorable for individual sheets, whereas a smaller extent of overlapping in the group of sheets released from the preliminary sheet-aligning means can cause a relatively small velocity of sheets displaced in a reversed direction during the preferably uniform advancing movement of both groups.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
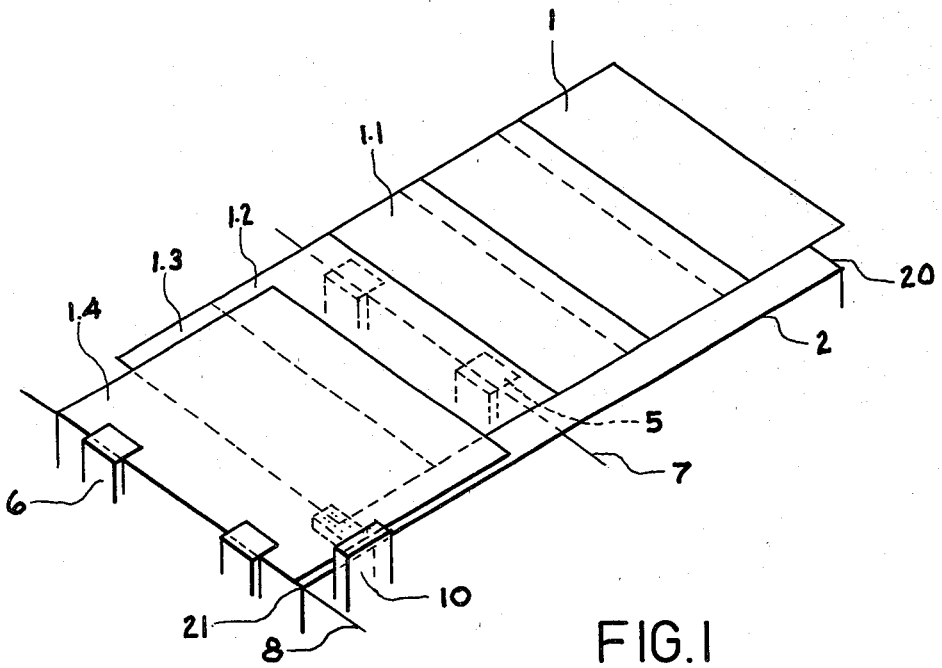
FIG. 1 is a schematic top view of a sheet-feeding arrangement according to the invention.

Referring to the drawings it is emphasized that only those aspects of the arrangement are illustrated which are necessary for an understanding of the invention. In all other respects the arrangement corresponds to that disclosed in GDR Patent No. 132,652 which herewith incorporated in its entirety by reference. As the drawing shows, a number of overlapped sheets 1, 1.1, 1.2, 1.3 and 1.4 are placed on a feeding table 2 for advancing movement from a rear end 20 toward a front end 21 thereof to be further fed into a not-illustrated sheet-processing machine, for example a printing machine. The advancing movement of the overlapped sheets is attained by means of a belt conveyor 3.1, a belt conveyor 3.2 and corresponding rollers 4 in the manner well-known in the art. A pair of preliminary front stops 5 and a pair of final front stops 6 are arranged on the feeding table 2 to align the sheets being advanced at their front edges. The preliminary stops 5 are laterally spaced one from another and mounted at an aligning line 7 rearwardly from the front edge 21 of the table 2, whereas the final stops 6 are also laterally spaced one from another but positioned at an aligning line 8 coinciding with the front end 21 of the table. The distance a between the aligning lines 7 and 8 is at least equal to the length of the individual sheets so that when stops 5 are pivoted down (leftwardly in the Figures) they do not interfere with (move) the sheets already abutting the stops 6.

A transporting suction head 9 is arranged in the area of the aligning line 7. A pulling arrangement 10 is rigidly mounted on the table 2 for aligning the advancing sheets at their lateral edges. The pulling arrangement includes a lateral support 10.1 and a pulling element 10.2, for example a suction head.

The preliminary stops 5 are pivotable in downward direction so that in an (upper) working position they orient the front edges of the advancing sheets and when pivoted down the stops 5 allow the sheets to be further advanced by the conveyor 3.2 and rollers 4 toward the stops 6.

Figure 2:
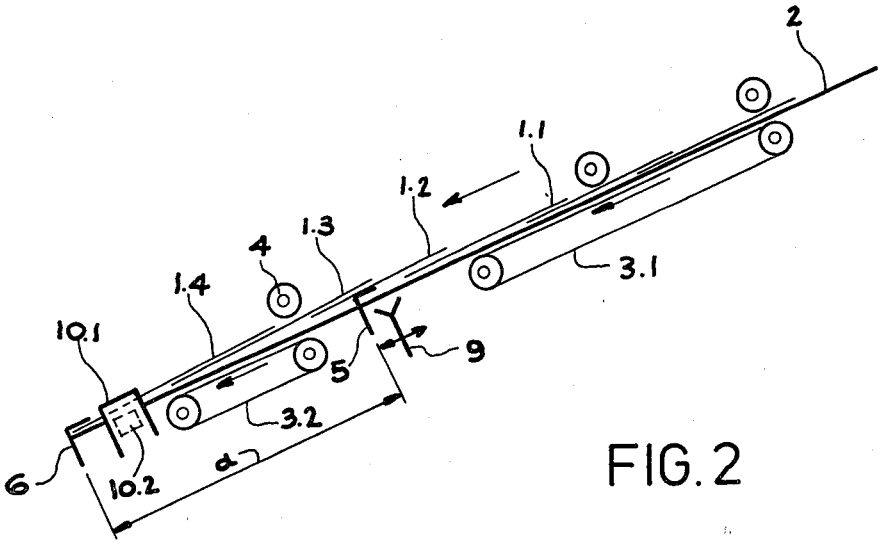
FIG. 2 is a schematic side view of the arrangement shown in FIG. 1.

In operation, a stream of overlapped sheets preliminarily separated from a supply feeder stack are placed onto the table 2 and moved from the rear end 20 of the table by the first belt conveyor 3.1 toward the stops 5 where one individual sheet for example sheet 1.1 shown in FIG. 2 stops and in the stationary position thereof is aligned at its front edge.

Then the preliminary stops 5 are simultaneously pivoted downwardly, thus freeing the path for sheet 1.1 to move from the transporting suction head 9 toward the area of the second belt conveyor 3.2 which moves the preliminary aligned sheets further toward the final stops 6. Due to the advancing movement of the sheets and simultaneous alignment thereof at their front edges the sheets being fed are positioned in overlapped relationship to form a group of overlapped sheets 1.2, 1.3 and 1.4 of which sheet 1.3 is located under sheet 1.4 and superimposes sheet 1.2. Due to the fact that each succeeding sheet slides underneath the preceding sheet, such sliding movement will urge the preceding sheet forwards toward the stops 6. Thus, should one of the sheets have rebounded on contact with the stops 6, the next following sheet will inject forwards to proper alignment position. When the sheet 1.4 reaches a position at which it engages with the stops 6 the sheet 1.4 will be finally aligned at its front edge by stops 6 and at its lateral edges by means of the support element 10.1 of the pulling arrangement and thereafter removed from the table 2 to be fed into the printing machine for further processing.

Drive means for the belt conveyors 3.1 and 3.2 (not shown in the drawings) may be so arranged that the conveyors will move with different velocities to thereby provide a different extent of overlapping between two successive groups of overlapped sheets.

The preliminary front stops 5 may be specifically arranged and utilized for collecting the sheets being advanced, for controlling the position of the sheets on the table and for blocking supply of the sheets if necessary.

The sheet 1.1 may also be aligned at their lateral edges when engages the preliminary front stops 5 by means of additional pulling arrangement (not shown) which is analogous to the pulling arrangement 10 provided for final stops 6.

It will be understood that each of the elements described above, or two or more together, may also find a useful application in other types of sheet-feeding arrangement differing from the types described above.

While the invention has been illustrated and described as embodied in a sheet-feeding arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a sheet-feeding arrangement, particularly for use in printing machines, a combination comprising a sheet-feeding table having a rear end and a front end; means for advancing a stream of overlapped sheets from said rear end towards said front end; preliminary sheet-aligning means rearwardly spaced from said front end, said preliminary sheet-aligning means including at least two stops laterally spaced from each other and stopping an individual sheet to be aligned and preliminary aligning its front edge at the stationary position thereof, said stops being arranged to pivot downwardly to allow the preliminary aligned sheet to be further advanced towards said front end, said advancing means further advancing the preliminary aligned sheet towards said front end; and final sheet-aligning means at said front end, said preliminary and final sheet-aligning means being spaced from one another in the direction of sheet advancement by a distance which is at least equal to the length of the individual sheets of said stream.

2. The combination of claim 1, wherein said advancing means include a first belt conveyor located before said preliminary sheet-aligning means and a second belt conveyor located between said preliminary sheet-aligning means and said final sheet aligning-means.

3. The combination of claim 2, further comprising a transporting suction head arranged in the region of said preliminary-aligning means.

4. The combination of claim 3, wherein said first belt conveyor and said second belt conveyor have different velocities.

5. The combination of claim 4, wherein said final sheet-aligning means include at least two stops laterally spaced from each other.

6. The combination of claim 5, further comprising pulling means adapted to align lateral edges of the sheets of said stream and positioned in proximity to said final sheet-aligning means.

7. The combination of claim 6, further comprising additional means for aligning lateral edges of the sheets of said stream, said means being engaged with said preliminary sheet-aligning means.

* * * * *